US008590881B2

(12) United States Patent
Kotani

(10) Patent No.: US 8,590,881 B2
(45) Date of Patent: Nov. 26, 2013

(54) SHEET POST-PROCESSING DEVICE

(75) Inventor: Takashi Kotani, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/369,491

(22) Filed: Feb. 9, 2012

(65) Prior Publication Data

US 2012/0211934 A1 Aug. 23, 2012

(30) Foreign Application Priority Data

Feb. 17, 2011 (JP) ..... P2011-032446

(51) Int. Cl.
*B65H 39/00* (2006.01)

(52) U.S. Cl.
USPC ..... 270/58.07; 270/60

(58) Field of Classification Search
USPC ..... 270/60, 58.07
See application file for complete search history.

(56) References Cited

U.S. PATENT DOCUMENTS 6,290,220 B1 * 9/2001 Takehara et al. ..... 270/58.12
7,300,045 B2 * 11/2007 Terao et al. ..... 270/58.08
7,607,652 B2 * 10/2009 Kushida ..... 270/58.12
7,690,633 B2 * 4/2010 Tamura et al. ..... 270/37
7,900,912 B2 3/2011 Moriyama et al. ..... 271/220
2006/0103065 A1 5/2006 Kotani ..... 271/3.14
2008/0308991 A1 * 12/2008 Sasahara et al. ..... 270/58.08

FOREIGN PATENT DOCUMENTS

JP 2009-166949 7/2009
JP 2009-242049 10/2009

* cited by examiner

*Primary Examiner* — Leslie A Nicholson, III
(74) *Attorney, Agent, or Firm* — Ostrolenk Faber LLP

(57) ABSTRACT

A sheet post-processing device includes: a temporary holding unit temporarily holding a sheet supplied by an image forming apparatus; and a shifting unit performing a shifting operation on a sheet bundle, the sheet bundle including two or more sheet, wherein an extra sheet not included in the sheet bundle is supplied to the shifting unit without temporarily holding the extra sheet in the temporary holding unit or by shortening a holding duration time in the temporary holding unit; and when the shifting operation is not completed on a sheet in queue immediately before the extra sheet when the extra sheet is received, the shifting unit is set to a waiting condition until the extra sheet is supplied to the shifting unit.

7 Claims, 4 Drawing Sheets

SHEET POST-PROCESSING DEVICE

BACKGROUND OF THE DISCLOSURE

The present disclosure relates to a sheet post-processing device. This sheet post-processing device is added to an image forming apparatus such as a copying machine, a printer, and the like.

Priority is claimed on Japanese Patent Application No. 2011-032446, filed Feb. 17, 2011, the content of which is incorporated herein by reference.

A sheet post-processing device is attached to an image forming apparatus. The sheet post-processing device is configured so that a sheet ejected from the image forming apparatus in series is stacked neatly. An image is formed on the sheet. The sheet post-processing device is also configured to perform a sorting process arranging the position of the sheet for each stack. Furthermore, the sheet post-processing device is configured to perform a post-processing operation for each stack. An example of the post-processing operation includes performing a stapling process for each stack.

The sheet post-processing device performs a shifting operation in order to neatly stack a plurality of sheets. The shifting operation refers to an operation of shifting the sheet in a width direction (i.e., a direction perpendicular to the direction in which the sheet is transported). When this shifting operation is performed for each sheet, the duration of time required for the shifting operation becomes too long considering the speed at which a sheet is supplied by the image forming apparatus. As a result, a waiting time occurs at the image forming apparatus side. Hence the productivity of the image forming apparatus declines.

In order to solve these problems, conventionally, a holding mechanism is provided inside the sheet post-processing device which holds a sheet. As a result, sheets are stacked, and a shifting process is performed.

Normally, a sheet post-processing device performs a shifting process for a bundle of only a few sheets such as two sheets or three sheets. As a result, when a stack of sheets includes more than the number of sheets included in one sheet bundle or unit, the shifting process is performed for each sheet bundle. Thus, the shifting process is performed for all of the sheets included in the stack of sheets. Thereafter, the stack of sheets is ejected.

When the number of sheets included in one unit equals two, and a shifting process is performed, the sheet post-processing device temporarily holds the first sheet supplied by the image forming apparatus. Two sheets supplied by the image forming apparatus are stacked. Thereafter, the shifting process is performed.

When the number of sheets included in one unit equals three, and a shifting process is performed, the sheet post-processing device temporarily holds the first and second sheet supplied by the image forming apparatus. The third sheet supplied by the image forming apparatus is stacked with the first and second sheets. Thereafter, the shifting process is performed.

During an arranging process, when the number of sheets in one stack of sheets is not equal to a multiple of the number of sheets in one unit on which the shifting process is performed, an extra sheet remains at the end.

For example, when the number of stacks of sheets ejected is one, a problem does not occur. However, when a plurality of stacks of sheets are ejected, it is necessary to change the position of the stack of sheets that is ejected after the stack of sheets that is ejected first. As a result, the shifting position of the sheets is altered.

Therefore, it is not possible to stack a sheet, included in a stack ejected later, with an extra sheet that remains at the end of a stack ejected earlier. Hence, in order to prevent any waiting time of the image forming apparatus, it is necessary to prevent the extra sheet from being held in the sheet post-processing device. Alternatively, it is necessary to eject the extra sheet after only a short amount of holding time.

However, even when it is attempted to prevent the extra sheet from being held in the sheet post-processing device, or to eject the extra sheet after only a short amount of holding time, a waiting time of the image forming apparatus occurs when the shifting process of the stack ejected earlier is not yet completed because the extra sheet cannot be sent in the forward direction.

The present disclosure is made according to these considerations. An object of the present disclosure is to reduce any waiting time of an image forming apparatus due to an operation of a post-processing device. Another object of the present disclosure is to enhance the productivity of an image forming apparatus.

SUMMARY

A sheet post-processing device, according to an aspect of the present disclosure, is a sheet post-processing device that includes a temporary holding unit and a shifting unit. The temporary holding unit temporarily holds a sheet supplied by an image forming apparatus. The shifting unit performs a shifting operation on a sheet bundle, the sheet bundle including two or more sheets. Here, an extra sheet not included in the sheet bundle is supplied to the shifting unit without temporarily holding the extra sheet in the temporary holding unit or by shortening a holding duration time in the temporary holding unit. When the shifting operation is not completed on a sheet in queue immediately before the extra sheet when the extra sheet is received, the shifting unit is set to a waiting condition until the extra sheet is supplied to the shifting unit.

According to the present disclosure, it is possible to reduce any waiting time of an image forming apparatus. It is also possible to enhance the productivity of an image forming apparatus.

DESCRIPTION OF THE PREFERRED EMBODIMENTS

An embodiment of the present disclosure is described with reference to the diagrams. Incidentally, in the following diagrams, the scale of each component is altered so that each component may be viewed easily.

Figure 1:
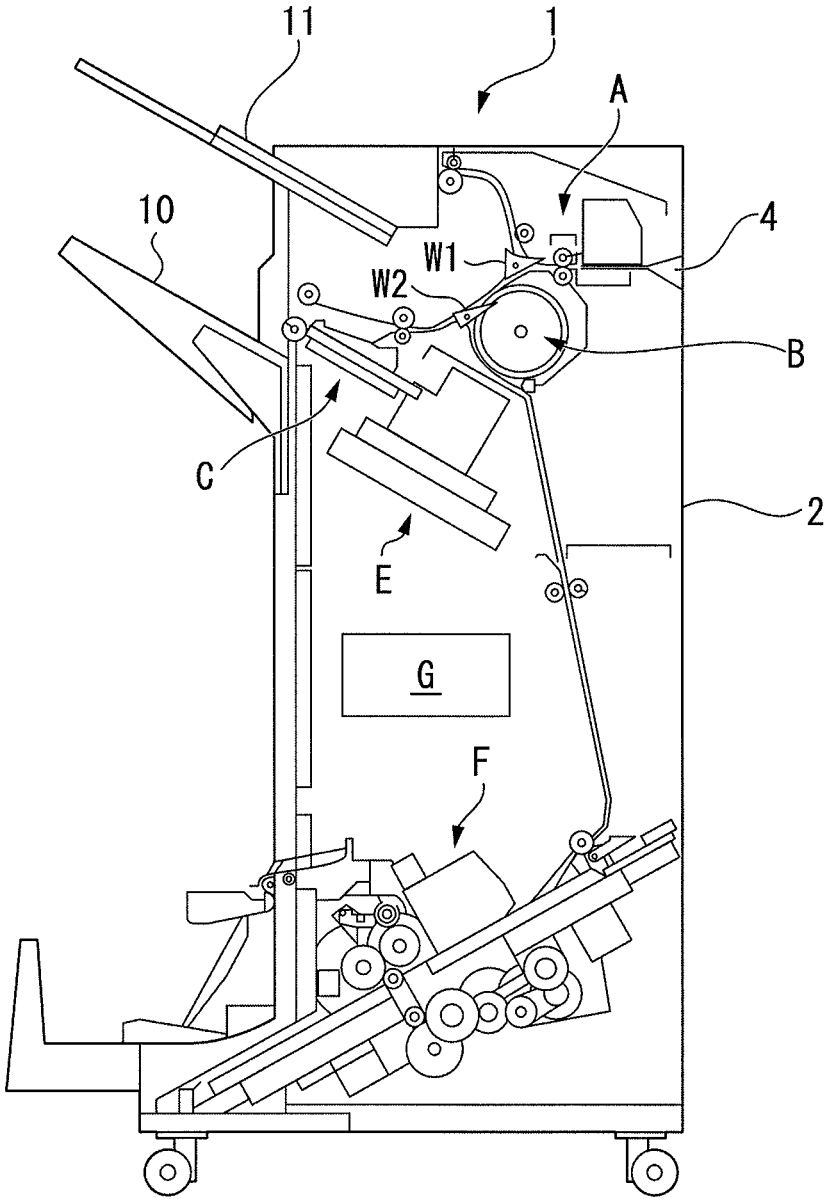
FIG. 1 is a cross sectional diagram showing a skeletal configuration of a sheet post-processing device according to an embodiment of the present disclosure.
Figure 2:
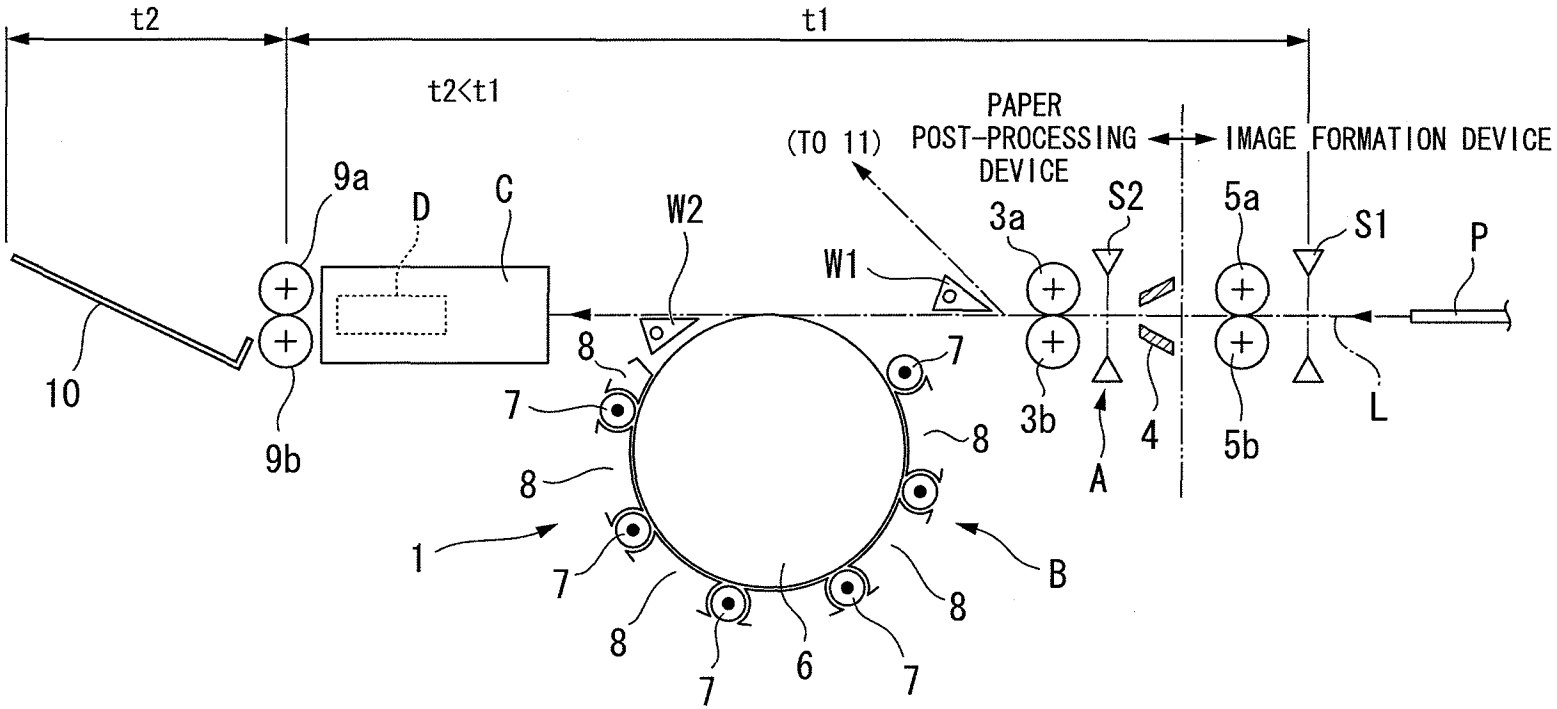
FIG. 2 is a skeletal configuration diagram showing a flow of a sheet inside a sheet post-processing device according to the above embodiment.
Figure 3:
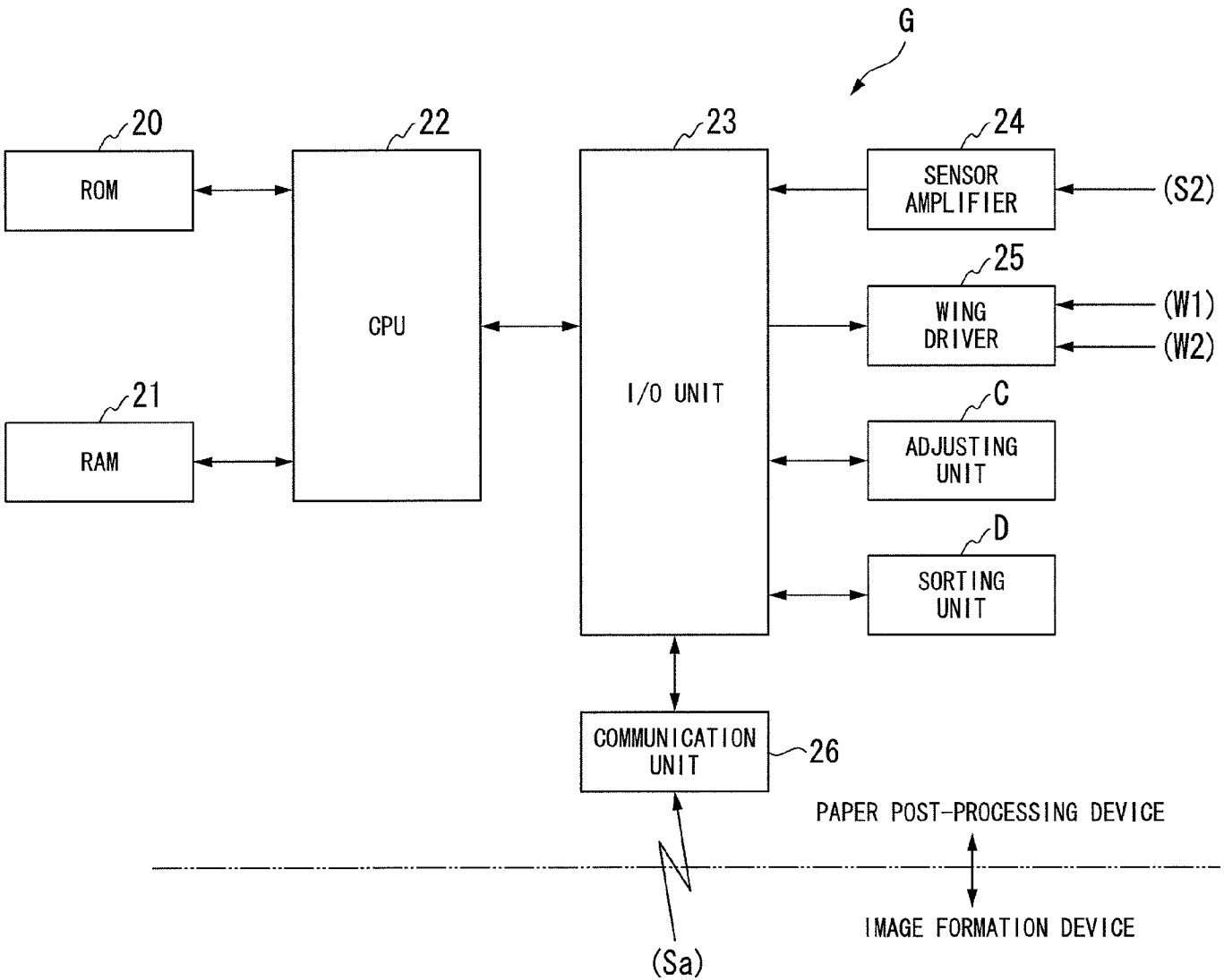
FIG. 3 is a block diagram of components of a control unit inside a sheet post-processing device and the components inside the sheet post-processing device connected to the control unit according to the above embodiment.

FIG. 1 is a cross sectional diagram showing a skeletal configuration of a sheet post-processing device 1. FIG. 2 is a skeletal configuration diagram showing a flow of a sheet P inside the sheet post-processing device 1. This sheet post-processing device 1 includes a chassis 2 which is a parallelepiped. Inside this chassis 2, a sheet imputing part A, a temporary holding unit B, an adjusting unit C, a shifting unit D, a stapling unit E, a booklet unit F, and a post-processing control unit G are located.

Inside the chassis 2, a roller cluster and a transporting path L are provided (see FIG. 2). The roller cluster transports a sheet inputted into the chassis 2. The transporting path L is configured by a guiding plate and the like. A wing W1 and a wing W2 are provided in a midway of the transporting path L. The wings W1, W2 are driven by a solenoid which is not diagramed. In this way, it is possible to change the direction in which the sheet P is transported. Incidentally, the transporting path L in FIG. 2 is drawn so that the right side corresponds to an upstream side, and the left side corresponds to a downstream side. The transporting path L is configured so that the sheet P is transported from the upstream side to the downstream side.

The sheet inputting part A includes a pair of rollers 3*a*, 3*b* installed at the downstream side of a reception opening 4 provided in the chassis 2. This sheet inputting part A receives the sheet P being ejected from an image forming apparatus, the sheet P being sandwiched by a pair of outputting rollers 5*a*, 5*b* provided on the image forming apparatus. The received sheet P is then inputted into the chassis 2. The sheet P ejected via the outputting rollers 5*a*, 5*b* of the image forming apparatus may be detected by an outputting detecting sensor S1. The outputting detecting sensor S1 is provided at the upstream side of the outputting rollers 5*a*, 5*b* and is formed by a photo sensor and the like. Further, the sheet P inputted into the chassis 2 by the rollers 3*a*, 3*b* may be detected by the sensor S2.

The temporary holding unit B includes a large-radius drum 6, a plurality of small rollers 7, and a plurality of guiding plates 8. The plurality of small rollers 7 are provided around the drum 6. A predetermined amount of space is provided between each of the small rollers 7. The plurality of guiding plates 8 is provided between the plurality of small rollers 7. Therefore, this temporary holding unit B may hold the sheet P outputted by the sheet inputting part A by wrapping the sheet P around the surface of the drum 6.

The adjusting unit C stacks a side of a sheet inputted into the chassis 2 so that the side faces a standard surface (standard plate). Further, the adjusting unit C adjusts the stacked sheet by making the side of the sheet contact the standard plate. In other words, the adjusting unit C includes a vibrating movable plate and a rotating flexible chip. The vibrating movable plate pushes the sheet P toward a bottom surface of the mounting plate. At the same time, the rotating flexible chip makes the front surface of the sheet P brush against the standard surface side. As a result, the sheet P is adjusted so that one side of the sheet P contacts the standard surface.

The shifting unit D includes a cursor which sandwiches both sides of the sheet P in a width direction. This width direction refers to a direction perpendicular to the direction in which the sheet P is transported. The shifting unit D performs a shifting operation for a predetermined amount of distance in the width direction while sandwiching both sides of the sheet P with the cursor. Therefore, when the sheet P is ejected from the ejecting rollers 9*a*, 9*b* provided at the downstream side of the adjusting unit C, it is possible to mount the sheet P so that each stack is placed at a slightly different position on the tray 10.

In other words, according to the above embodiment, the shifting unit D performs a shifting operation adjusting the position in the width direction at which the sheet P is ejected. In the above embodiment, a sorting operation includes the adjusting operation and the shifting operation.

The stapling unit E performs a binding operation by stapling one portion or a plurality of portions of a side of an adjusted sheet. Further, the booklet unit F can fold up a sheet inputted into the chassis 2, if necessary.

The post-processing control unit G includes a central processing unit (CPU) 22 which performs a computation process using working data held in a random access memory (RAM) 21 and using a system program held in a read only memory (ROM) 20.

A sensor amplifier 24, a wing driver 25, the adjusting unit C, and the shifting unit D are connected to the CPU 22 via an input/output (I/O) unit 23. The sensor amplifier 24 inputs the detection signal of the sensor S2. The wing driver 25 drives and controls the wings W1, W2. A communication unit 26 is connected to the I/O unit 23. The CPU 22 is connected to a main body control unit of the image forming apparatus via the communication unit 26. The main body control unit is not diagrammed. The CPU 22 may obtain various information on the sheet P including the detection signal of the output detecting sensor S1. Such information is collected by the main body control unit of the image forming apparatus. Incidentally, the stapling unit E, the booklet unit F, and a punching unit (not diagrammed) are connected to the I/O unit 23. Here, the descriptions of these components are not detailed.

Before a control operation according to the above embodiment is described, an overall operation performed by the sheet post-processing device configured as described above is explained. The sheet P is ejected from the image forming apparatus. This sheet is taken in by the sheet inputting part A. When it is not necessary to perform a post-processing on the inputted sheet P, such as a sorting operation or a stapling operation and the like, the inputted sheet P is led to the tray 11 via one slanted position of the wing W1. Hereinafter, this slanted position is referred to as a normal position. The other slanted position of the wing W1 is referred to as an opposite position. When a post-processing is performed on the inputted sheet P, the inputted sheet P is led to the temporary holding unit B side via the opposite position of the wing W1. When it is not necessary to temporarily hold the sheet P led to the temporary holding unit B side, the sheet P is led to the adjusting unit C via the normal position of the wing W2. When the sheet P led to the temporary holding unit B side is temporarily held, the sheet P is temporarily held by being led to the temporary holding unit B via the opposite position of the wing W2. When it is not necessary to temporarily hold the sheet P led to the temporary holding unit B side, but is necessary to perform a folding operation, the sheet P is led to the booklet unit F via the opposite position of the wing W2. The sheet P being processed at the booklet unit F is once again sent to the temporary holding unit B side.

When the post-processing being performed on the sheet P sent from the temporary holding unit B side is a stapling process, the sheet P is brought into the adjusting unit C. The sheet P is stacked by making one side of the sheet P contact the standard surface. The stacked sheet is moved to a predetermined position of the next stapling unit E in a condition such that one side of the sheet P contacts the side surface. In this condition, the sheet P is being adjusted. Thereafter, a binding operation is performed by the stapling unit E. The bound sheet is then ejected to the tray 10 by the ejecting rollers 9*a*, 9*b*. Incidentally, the process of sorting the sheet to each stack is described later in further detail.

Figure 4:
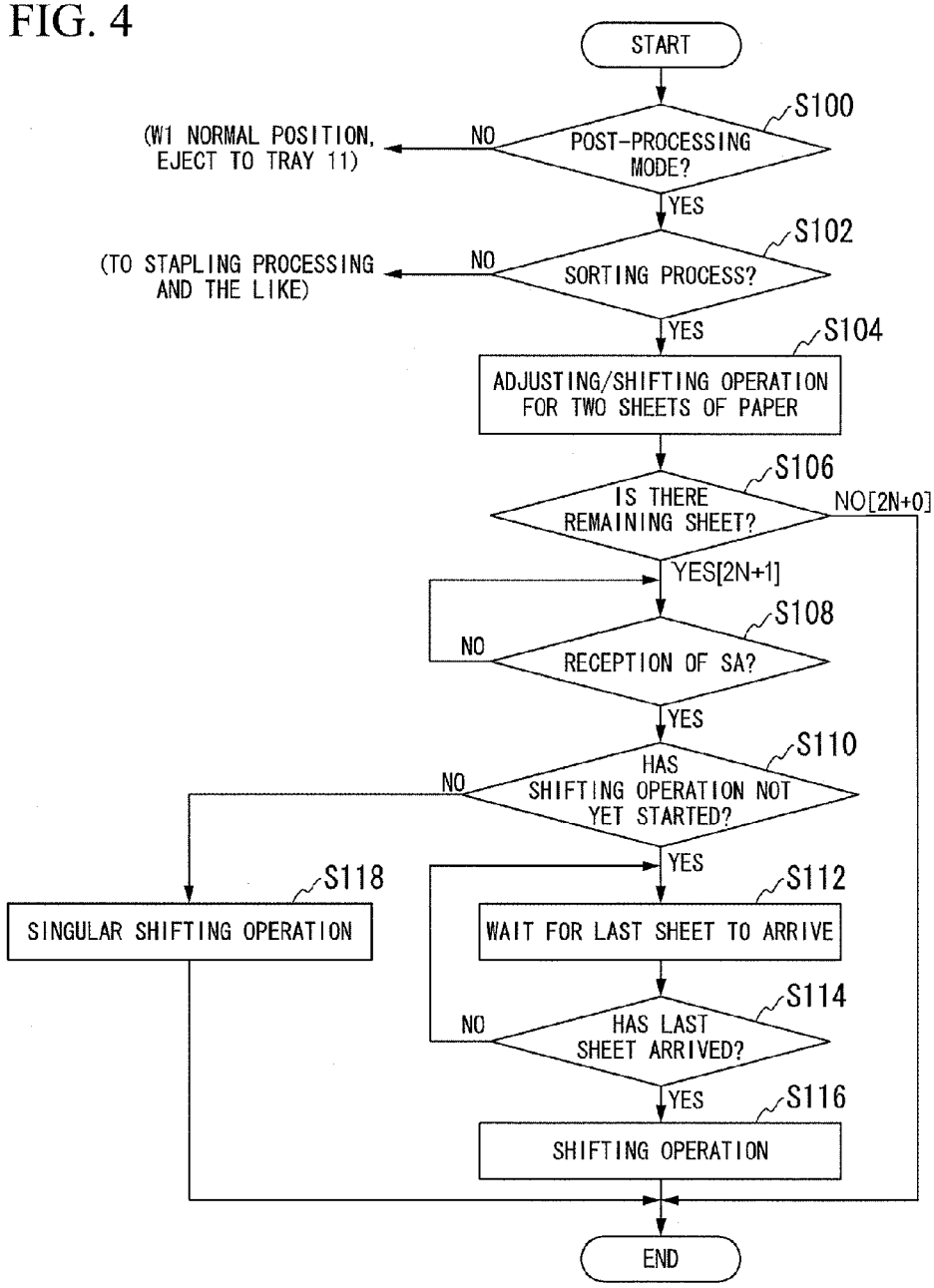
FIG. 4 is a flow chart showing a control operation according to the above embodiment.

Hereinafter, a sorting operation is described with reference to the flowchart shown in FIG. 4. This flowchart represents the control operation. Before describing the control operation, basic conditions and the like are explained with reference to FIG. 2.

First, the inequality t1>t2 holds. The variable t1 refers to the duration of time necessary for the sheet P to be transported to the ejection rollers 9*a*, 9*b* provided at the downstream side of the adjusting unit C of the sheet post-processing device 1 from a position of the output detection sensor S1 provided in the image forming apparatus without being temporarily held in the temporary holding unit B. In other words, the variable t1 refers to the duration of time between the detection of the tip of the sheet P in the traveling direction by the output detection sensor S1 to the arrival of the tip to the ejection rollers 9*a*, 9*b*. Said differently, the variable t1 refers to the duration of time between the detection of the rear tip of the sheet P by the output detection sensor S1 to the passage of the rear tip from the ejection rollers 9*a*, 9*b*. Next, the variable t2 refers to the duration of time of one sorting operation by the shifting unit D. In other words, the variable t2 refers to the duration of time between the sandwiching of both sides of the sheet P in the width direction by the cursor and the completion of the shifting movement.

The adjusting unit C is configured so that two sheets being superimposed is one unit. This configuration is made to perform the adjustment process well. Thus, the number of sheets in one unit according to the procedure based on the above embodiment is two. Therefore, according to the configuration of the temporary holding unit B, the first sheet of a unit is temporarily held in the temporary holding unit B. When the second sheet of the unit is transported, the second sheet of the unit is sent to the adjusting unit C along with the first sheet of the unit so that the second sheet of the unit is superimposed on the first sheet of the unit.

Therefore, when the number of sheets in one stack is an odd number (i.e., not a multiple of the number of sheets in one unit), the total number of sheets is represented by [2N+1]. One extra sheet is produced. Hereinafter, this extra sheet is referred to as the "extra sheet."

Incidentally, when the number of sheets in one unit is three, and when the number of sheets in a stack is not a multiple of this number three, the total number of sheets in the stack is represented by [3N+1], [3N+2]. Thus, one extra sheet is produced, or two extra sheets of the unit are produced.

In other words, when the number of sheets in one unit is X, and when the number of sheets in a stack is not a multiple of this number X, the total number of sheets in the stack is represented by [XN+Y]. The number of extra sheets being produced is less than or equal to Y.

In the following description, the number of sheets in one unit is set to two. If necessary, supplemental explanations are provided in cases where the number of sheets in one unit is greater than or equal to three.

The image forming apparatus is started. The sorting processing mode is selected as a post-processing mode of the sheet post-processing device attached to the image forming apparatus. (The result of step 100 in FIG. 4 is Yes. The result of step 102 in FIG. 4 is Yes. Hereinafter, step is referred to as S, Yes is referred to as Y, and No is referred to as N.) When a post-processing mode is not selected (S100N), the sheet P, on which an image is formed by the image forming apparatus, is ejected to the tray 11 via a normal position of the wing W1. When the sorting processing mode is not selected (S102N), a stapling process and the like is performed.

When the sorting processing mode is selected (S102Y), the first sheet P, detected by the sensor S2, is temporarily held by the temporary holding unit B via the opposite position of the wing W1 and the opposite position of the wing W2. When the next sheet P is detected by the sensor S2, this next sheet P is transported to the temporary holding unit B side via the opposite position of the wing W1. The sheet P, which was detected first and is held temporarily in the temporary holding unit B, is stacked with the sheet P which was detected next. The stacked sheets of unit of sheets P, P are adjusted by the adjusting unit C. The adjusted unit of sheets P, P, undergoes a shifting process by the shifting unit D. Thereafter, the adjusted sheets of unit P, P are placed on the tray 10 (S104). Such an adjusting/shifting operation is repeated until all the sheets in one sheet bundle are processed.

According to the shifting operation described above, when the number of sheets in one stack is an even number, for example, 6 (S106N), all of the sheets P being supplied to the sheet post-processing device 1 may be grouped so that two sheets form one unit. Therefore, a normal shifting operation is performed. Incidentally, the term 0 in the notation [2N+0] in S106N means that there is no extra sheet.

Meanwhile, when the number of sheets in one stack is an odd number, for example, 5 (S106Y), one sheet remains at the end. In other words, one extra sheet is present. The term 1 in the notation [2N+1] in S106Y means that there is one extra sheet.

The image forming apparatus outputs a final signal Sa when the last sheet among the sheets included in a stack is detected by the output detection sensor S1. The final signal Sa indicates that this sheet is the last sheet of the stack of sheets. In other words, the final signal Sa indicates that, among the sheet included in a stack, the last sheet has been ejected.

Therefore, when one extra sheet is present as described above, the extra sheet P is detected by the output detection sensor S1 provided in the image forming apparatus. Therefore, a final signal is outputted from the image forming apparatus. The final signal indicates that, among the sheets included in a stack, the last sheet has been ejected. When this final signal Sa is received by the CPU 22 from the image forming apparatus (S108Y), the CPU 22 determines whether a shifting operation by the shifting unit D has been performed on the sheet P immediately prior to the extra sheet P. When it is determined that the shifting operation has not yet been performed (S110Y), the extra sheet P is supplied to the shifting unit D without holding the extra sheet P in the temporary holding unit B. The shifting operation is suspended until the extra sheet P reaches the shift unit D. Once the extra sheet reaches the shifting unit D, the shifting operation is performed (S112, S114Y, S116).

Incidentally, when the CPU 22 determines that the shifting operation has already begun (S110N), the extra sheet undergoes the shifting operation and is ejected (S118).

In this way, according to the sheet post-processing device 1 according to the above embodiment, a temporary holding unit B and a shifting unit D are provided. The temporary holding unit B may temporarily hold the sheet supplied by the image forming apparatus. The shifting unit D performs a shifting operation for a bundle of two sheets. When an extra sheet is supplied, this extra sheet is supplied to the shifting unit D without holding it in the temporary holding unit B. This extra sheet is a sheet that could not be included in the prior sheet units. When a sheet in queue immediately before the extra sheet has not yet undergone a shifting operation at the time the extra sheet is received, the shifting unit D is set to a waiting condition until the extra sheet is supplied to the shifting unit D.

In other words, according to the sheet post-processing device 1 based on the above embodiment, when an extra sheet not included in the sheet bundle for performing a sorting operation is supplied, and when the shifting operation for the sheet immediately before the extra sheet has not yet begun, the shifting operation is performed after the extra sheet has arrived.

Therefore, it is possible to supply the extra sheet to the shifting unit in a shorter amount of time. The productivity of the image forming apparatus may be enhanced without creating a waiting time of the image forming apparatus.

Incidentally, in the above description, the number of sheets in one unit is two. When the number of sheets in one unit is three, the number of sheets is represented as [3N+1], [3N+2]. Thus, there are instances in which one extra sheet is supplied or two extra sheets are supplied. When there is one extra sheet, processing is performed as described above. When the number of extra sheets is two, a shifting operation is performed on two superimposed sheets via the temporary holding unit B. When the number of sheets in one unit is X (greater than or equal to three), the number of sheets is represented by [XN+1], [XN+2], . . . [XN+Y]. The number of extra sheets present is less than or equal to Y. When the number of sheets in one unit is greater than or equal to three, a shifting operation is performed for three or more sheets of the unit. Therefore, even when a plurality of extra sheets is provided, the duration of time during which the extra sheets are held in the temporary holding unit B is shortened compared to the sheets of a unit.

Even in such cases, according to the sheet post-processing device 1 based on the above embodiment, when an extra sheet not included in one unit for performing a sorting operation is provided, and when a shifting operation for the sheet immediately before the extra sheet has not yet begun, the shifting operation is performed once the extra sheet has arrived.

Hence, the extra sheet may be provided to the shifting unit D within a shorter amount of time. Further, the productivity of the image forming apparatus may be enhanced without creating a waiting time of the image forming apparatus.

A preferable embodiment of the present disclosure has been described according to the attached figures. However, the present disclosure is not limited by the above description. The shapes and combinations of the components described in the above embodiment are only examples. Various alterations are possible that conform to the gist of the present disclosure.

The invention claimed is:

1. A sheet post-processing device comprising:

a temporary holding unit temporarily holding a sheet supplied by an image forming apparatus; and a shifting unit performing a shifting operation on a sheet bundle, the sheet bundle including two or more sheets, wherein at least one extra sheet supplied by the image forming apparatus is not included in a sheet bundle;

when one extra sheet is supplied by the image forming apparatus and when the shifting operation is not yet commenced on a sheet in queue immediately before the extra sheet when the extra sheet is received, the extra sheet is supplied to the shifting unit without holding the extra sheet in the temporary holding unit, the shifting operation is suspended until the extra sheet reaches the shifting unit, and the shifting operation is performed on the sheet in queue immediately before the extra sheet and on the extra sheet when the extra sheet reaches the shifting unit; and when one extra sheet is supplied by the image forming apparatus and when the shifting operation has commenced on a sheet in queue immediately before the extra sheet when the extra sheet is received, the extra sheet undergoes the shifting operation after the shifting operation on the sheet in queue immediately before the extra sheet has been completed.

2. The sheet post-processing device according to claim 1, wherein a determination is made as to whether a sheet supplied by the image forming apparatus is an extra sheet, based on a signal inputted from the image forming apparatus.

3. The sheet post-processing device according to claim 1, wherein the shifting unit is a sorting unit adjusting a position to which the sheet is ejected.

4. The sheet post-processing device according to claim 1, wherein a number of sheets in the sheet bundle is two.

5. The sheet post-processing device according to claim 1, further comprising a post-operation control part determining whether the shifting operation of the shifting unit has commenced on the sheet in queue immediately before the extra sheet.

6. The sheet post-processing device according to claim 1, wherein, when a number of sheets in the sheet bundle is three or more, and when a number of the extra sheets is two, after the shifting operation on the sheet in queue immediately before the two extra sheets has been completed, the two extra sheets are sent in a superimposed condition for the shifting operation to be performed on the two extra sheets.

7. The sheet post-processing device according to claim 1, wherein the temporary holding unit includes a drum.

* * * * *